United States Patent [19]

Cho

[11] Patent Number: 4,497,070

[45] Date of Patent: Feb. 5, 1985

[54] UNITARY LEG AND FOOT PROTECTIVE DEVICE

[75] Inventor: Soo S. Cho, Miami, Fla.

[73] Assignee: Macho Products, Inc., Palm Bay, Fla.

[21] Appl. No.: 450,403

[22] Filed: Dec. 16, 1982

[51] Int. Cl.[3] ..... A43B 5/00; A41D 13/08

[52] U.S. Cl. ..... 2/22; 36/2 R; 36/106; 128/165

[58] Field of Search ..... 2/22, 23; 36/2 R, 106; 128/80 R, 80 H, 87 R, 132 R, 165, 166

[56] References Cited

U.S. PATENT DOCUMENTS

| | | | |
|---|---|---|---|
| 3,506,000 | 4/1970 | Baker | 128/166 |
| 3,585,639 | 6/1971 | Enicks | 128/132 R |
| 3,769,722 | 11/1973 | Rhee | 36/2 R |
| 3,911,497 | 10/1975 | Lewis et al. | 128/165 X |
| 3,949,493 | 4/1976 | Rhee | 36/2 R |
| 4,008,531 | 2/1977 | Schonbrun et al. | 36/106 |
| 4,103,437 | 8/1978 | Dillard | 36/106 X |
| 4,168,584 | 9/1979 | Wren et al. | 36/2 R |
| 4,190,971 | 3/1980 | Wren et al. | 36/2 R |
| 4,313,433 | 2/1982 | Cramer | 128/166 X |
| 4,361,912 | 12/1982 | Arthur | 36/106 X |
| 4,361,970 | 12/1982 | Wren et al. | 36/106 |
| 4,397,105 | 8/1983 | Richardson | 36/106 |

*Primary Examiner*—Louis K. Rimrodt

*Attorney, Agent, or Firm*—John E. Benoit

[57] ABSTRACT

A unitary leg and foot protective device of soft energy absorbing material which may be worn by a human comprising a lower portion for covering the top and sides of the foot of the wearer, a middle portion for covering the front and sides of the ankle of the wearer and an upper portion covering the shin of the wearer.

19 Claims, 11 Drawing Figures

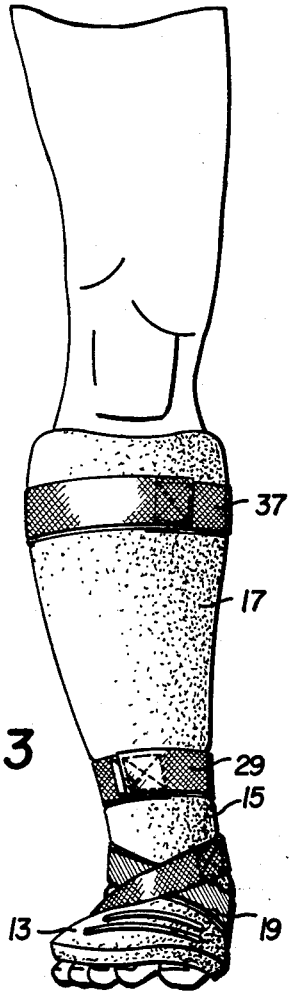
FIG. 3
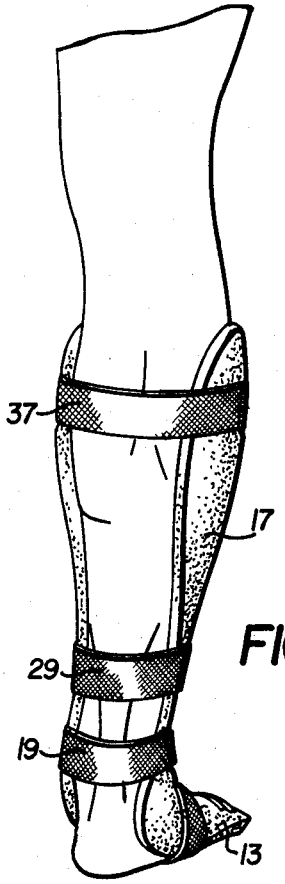
FIG. 4
FIG. 5
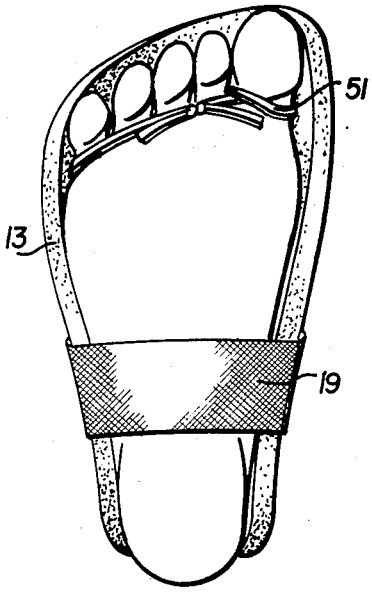
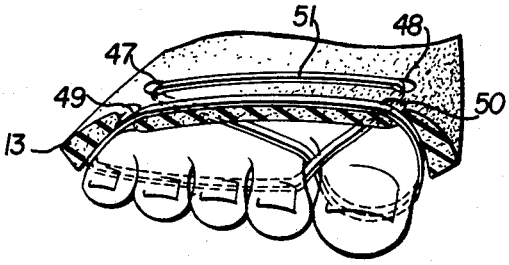
FIG. 6

UNITARY LEG AND FOOT PROTECTIVE DEVICE

This invention relates generally to devices for protection of parts of the human body and more specifically to a unitary leg and foot protection device.

In recent years, there have been provided various types of protective devices for use in the practice of the martial arts, such as karate, kung fu, etc. These protective devices have taken various forms and are used to protect various parts of the body, and, particularly, the feet, legs and hands.

Several examples of protective shoes are shown in U.S. Pat. Nos. 3,769,722, issued Nov. 6, 1973 and 3,949,493, issued Apr. 13, 1976. These devices are specifically designed for the foot alone and are secured to the foot of the wearer by various means.

It has also been proposed that a protective device be provided which would not only protect the foot but at the same time protect the lower leg. Such a device is shown in U.S. Pat. No. 4,008,531, issued Feb. 22, 1977, wherein three separate members are provided, one being a member to fit about the heel area, the second member adapted to cover the top portion of the foot and a third member covering a portion of the shin area. These protective pieces are produced individually and then they are secured together by stitching a covering type of material to the members. This, of course, requires considerable time consuming effort to ultimately provide the finished protective device.

Accordingly, it is an object of the present invention to provide a unitary leg and foot protective device of soft, energy-absorbing material.

A further object of the invention is to provide a unitary leg and foot protective device wherein straps are attached thereto so that the device may quickly and easily be attached and removed from the wearer.

A still further object of the invention is to provide a leg and foot protective device including a protective portion surrounding the heel with an upwardly extending flange passing to the rear of the leg over the lower area thereof.

It is yet another object of the invention to provide a unitary leg and foot protective device having straps attached thereto for securing the device to the leg and foot of the wearer and having a specific lacing arrangement in the foward part of the lower portion for maintaining the device on the forward part of the foot.

These and other objects of the invention will become apparent from the following description taken together with the drawings.

BRIEF DESCRIPTION OF THE DRAWINGS

FIG. 3 is a front perspective view of the device of FIG. 1 in place on the leg and foot of the wearer;

FIG. 4 is a rear perspective view of the device as mounted in FIG. 3;

FIG. 5 is a bottom view of FIG. 3 illustrating the preferred use of the lacing;

FIG. 6 is a partial sectional frontal view illustrating the preferred use of the lacing;

SUMMARY OF THE INVENTION

Figure 1:
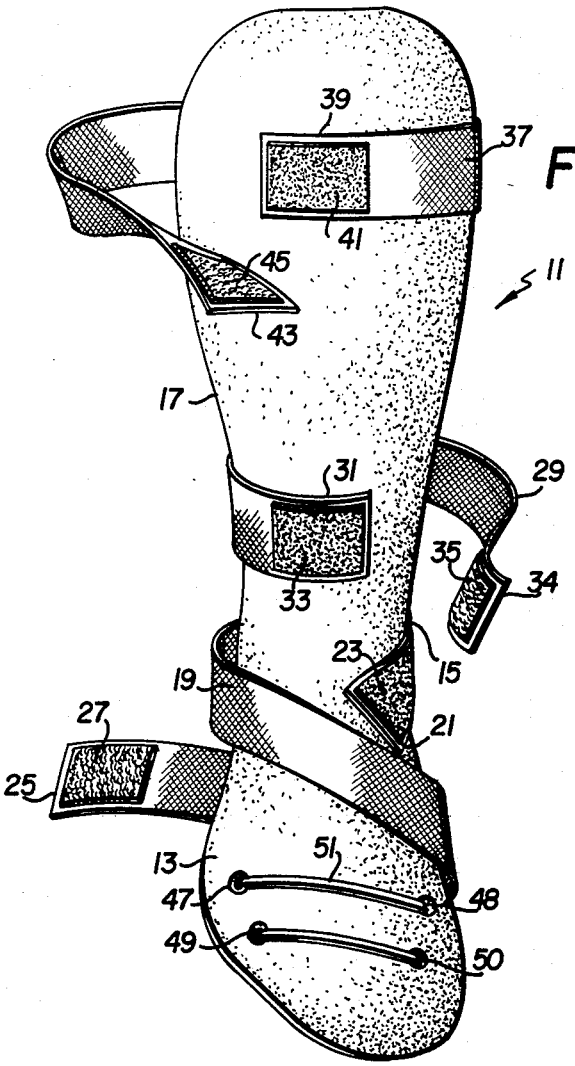
FIG. 1 is a front elevational view of one embodiment of the invention.

One embodiment of the present invention provides a unitary leg and foot protective device of soft energy absorbing material which may be worn by a human comprising a lower portion for covering the top and sides of the foot of the wearer, a middle portion for covering the front and sides of the ankle of the wearer and an upper portion covering the shin of the wearer. First strap means are secured at one end adjacent one end of the lower portion with the strap means having securing means attached to opposite ends thereof so that the strap means may cross over the top of the lower portion, underneath the lower portion, and over the top of the lower portion including a section of the strap with the free end of the strap being secured to the fixed end which is attached to the device. A second strap means is secured at one end to the upper portion of the device and also has mating securing means at opposite ends thereof so that the strap passes about the upper portion of the device with the free end being secured to the end attached to the uppper portion. A third strap may be connected at one end between said first and second strap means for larger sizes and also includes the mating securing means at opposite ends of the strap. The third strap means passes about the device and, again, has its free end attached to the end which is secured to the device. A plurality of perforations extend through the lower portion so as to accommodate a lace of sufficient length to pass through the perforations and under the first portion with the ends of the lace being tied together below the inner surface of the lower portion. The lace is preferably threaded so as to include two parallel sections over the top of the lower portion. If desired, the unitary device may also be constructed so as to include a unitary heel portion extending from the rear of the lower portion and a unitary flap extending upwardly from the heel portion for a predetermined distance.

DETAILED DESCRIPTION OF THE INVENTION

Before proceeding with the detailed description of the invention, it should be noted that the drawings disclose a unitary leg and foot protective device which, obviously, is designed for the right foot and leg. It is to be understood that the invention also includes a mating left leg and protective device which is a mirror image of the device of the right leg as shown in the drawings.

Turning now to FIGS. 1 through 6, there is disclosed one embodiment of the present invention.

Unitary protective device 11 comprises a lower portion 13, a middle portion 15 and an upper portion 17.

A strap 19, preferably of an elastic material, terminates at either end in securing means 23 and 27, herein shown as Velcro. In all cases described hereinafter, these Velcro securing means are attached to the straps by means such as stitching. The Velcro securing means 23 is attached adjacent to one end of the lower portion 13 by means such as adhesive or the like.

Strap 29, similar in structure to strap 19 terminates at both ends in Velcro securing means. End 31 is secured to the middle portion of the protective device by a means such as an adhesive or the like. This strap is not necessary for the smaller sizes of the protective device, since the lower strap 19 and upper strap 37 provide adequate securing means. Strap 37, constructed in a manner similar to strap 19, is secured at end 39 to the upper portion of the protective device in a similar manner.

Figure 2:
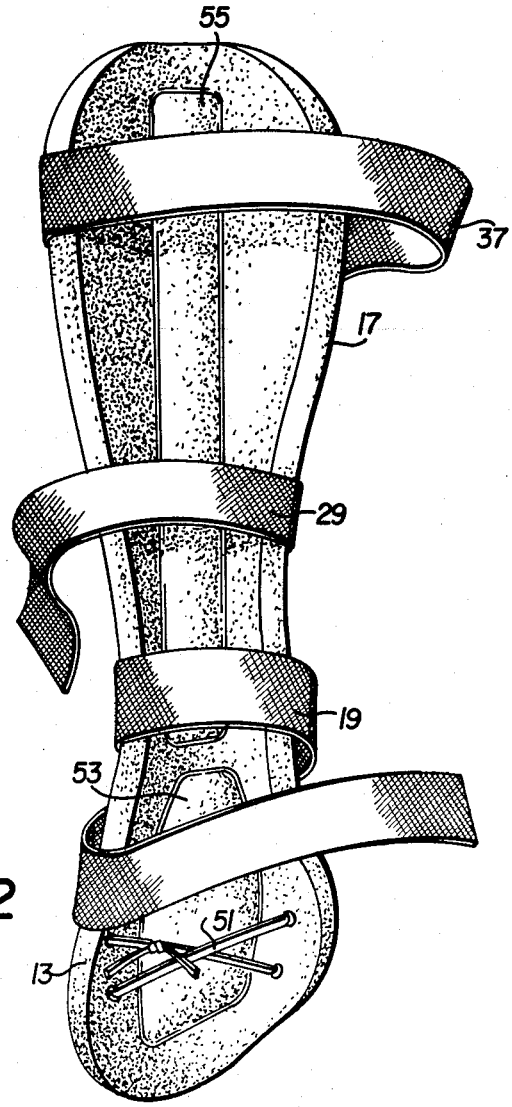
FIG. 2 is a rear elevational view of the protective device of FIG. 1.
Figure 7:
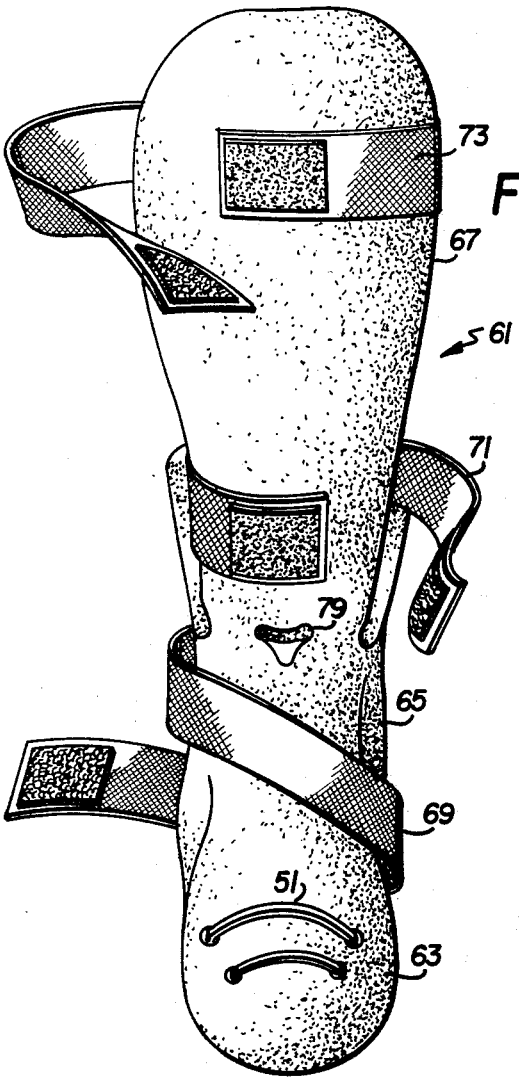
FIG. 7 is a front elevational view of a modification of the device of FIG. 1.

The lower portion 13 has a plurality of perforations 47, 48, 49 and 50 extending therethrough. A strap 51, also preferably of an elastic material, passes through the perforations and is crossed over itself as shown in FIG. 2 and tied at the lower surface of the lower portion 13. The showing of FIG. 2 illustrates the preferred lacing method wherein the lace includes two parallel sections over the upper surface with the lace crossing over itself below the inner surface and the ends tied as shown.

Turning specifically to the showing of FIG. 2, it can be seen that the protective device includes sections of increased thickness 53 and 55 in the lower portion and along the middle upper portion respectively. This adds increased protection for the upper part of the foot and along the ankle and shin of the wearer.

The method of applying or attaching the protective device to the leg and foot is illustrated by FIGS. 1 through 6. In this modification, the protective device is entirely open along the rear part of the upper, middle and lower portions so that the device may be placed directly on the leg and foot. The strap 19 passes over the top of the lower portion and underneath thereof and back, up and over the top of the lower portion, with Velcro section 27 mating with Velcro section 23 so as to provide a secure cross-over configuration as more clearly shown in FIG. 3. This strap is of sufficient length so as to assure a snug fit and yet maintain the device securely about the foot of the wearer. An elastic strap is preferred since it allows for a stretching before the final interconnection between Velcro sections 22 and 23.

Strap 29 is of a sufficient length so as to be wrapped around the rear of the protective device at the middle portion thereof with the mating Velcro sections 33 and 35 being secured together so as to hold the device tight around the middle portion of the lower part of the leg. Again, it is noted that this is only requred for the larger protective devices.

Strap 37 is of a sufficient length so as to pass about the rear of the protective device with mating Velcro sections 41 and 45 being secured together.

FIGS. 5 and 6 illustate the preferred method for securing lace 51 about the forward part of the foot. The securing method is made possible through the use of the particular lacing shown in FIGS. 1 and 2. The lace passes underneath the smaller toes, about the outside of the little toe and upwardly through perforation 49, across the top of the lower portion and downwardly through perforation 50. The lace then passes around and under the big toe, over the upper forward part of the foot and upwardly through perforation 47. Finally, the lace passes over the top of the upper portion, downwardly through perforation 48, between the big toe and the second toe, and is tied, as shown. This procedure effectively creates a first loop about the big toe and a second loop about the remaining toes. This technique provides maximum retention of the lower portion to the forward part of the foot within the protective device.

Turning now to FIGS. 7 through 11, it is to be understood that the modification shown therein is substantially the same as that previously described in relation to FIGS. 1 through 6 with the further unitary addition of the heel and flap member to be described.

Figure 8:
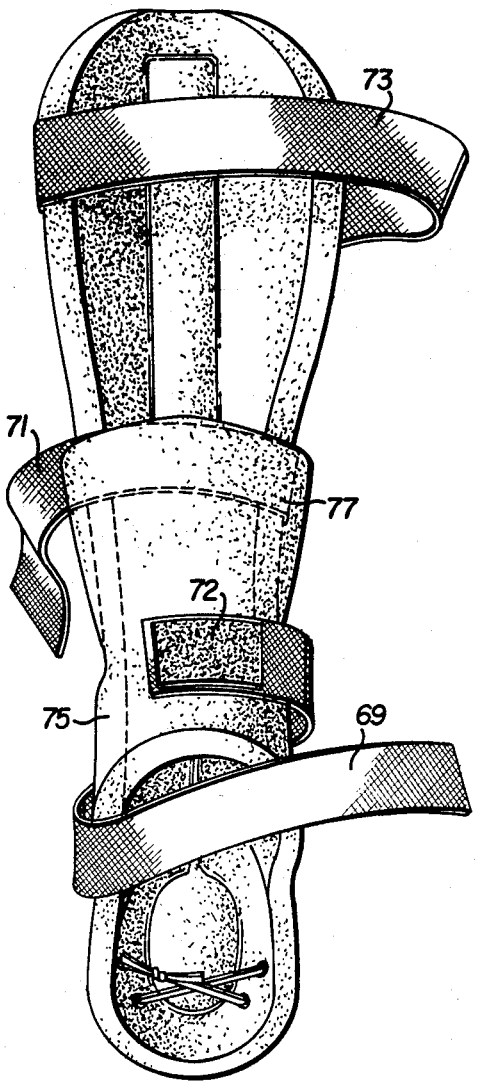
FIG. 8 is a rear elevational view of the device of FIG. 7.
Figure 9:
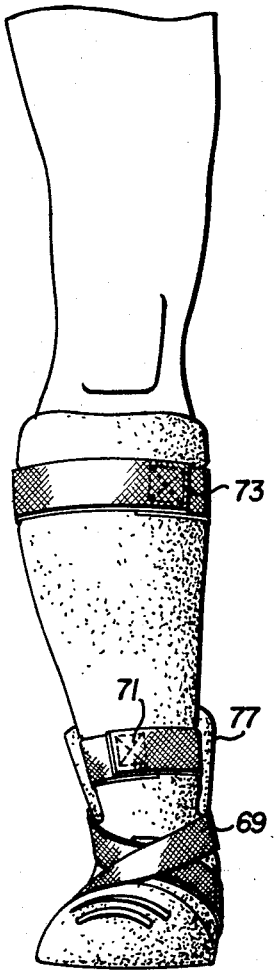
FIG. 9 is a front perspective view of the device of FIG. 7 on thé leg and foot of the wearer.
Figure 10:
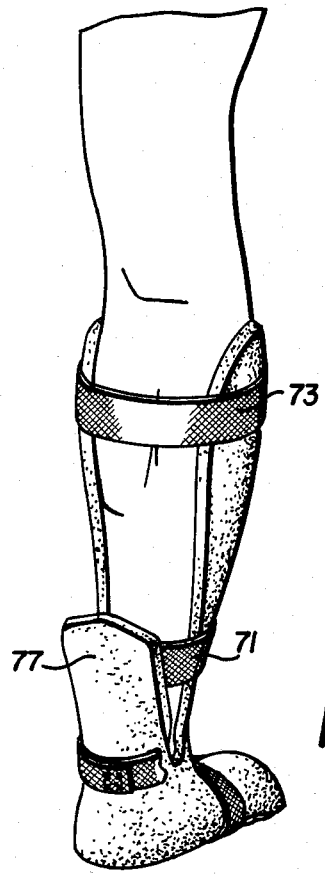
FIG. 10 is a rear perspective view of the device as mounted in FIG. 9.
Figure 11:
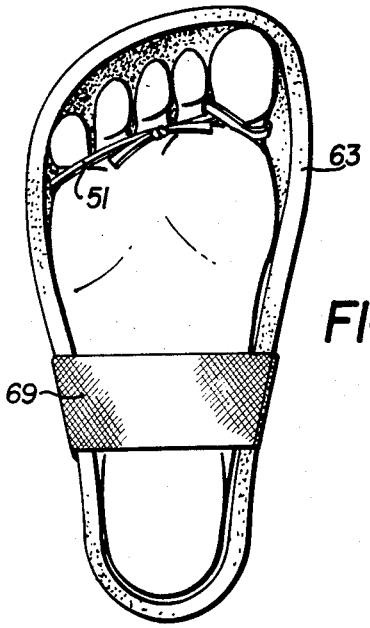
FIG. 11 is a bottom view of the device as mounted in FIG. 9.

Unitary protection device 61 is comprised of a lower portion 63, middle portion 65 and upper portion 67. As previously described, the three straps 69, 71 and 73 are shown for the purpose of illustration, it being understood that strap 71 is not required on smaller sizes. While strap 69 is still attached adjacent to the lower portion of the device, as can be seen in FIG. 8, in this embodiment the end 72 is attached adjacent to the rear area of the lower portion. The additional feature provided by this embodiment is a heel section 75, which is integral with the remaining part of the protective device, and a flap 77 extending upwardly from the heel portion and integral therewith. This addition is provided for protection of the heel and the area of the lower part of the leg adjacent and above the ankle.

Strap 69 is secured in substantially the same manner as strap 19 of the modification shown in FIGS. 1 through 5 in that it passes under the foot, over the top of the lower portion and crosses over itself so as to be secured with the Velcro securing means to the other end.

Straps 71 and 73 are substantially identical to straps 29 and 37 of the first embodiment. Additionally, lace 51 is the same as shown in FIG. 1 and provides the same function as previously described relative to FIGS. 5 and 6 of the first embodiment.

It will be noted that strap 71, if used, passes over the rear of the middle portion but does not pass over flap 77.

Since, in this modification, the foot must be inserted downwardly through the opening which now exists in the lower portion, a triangularly shaped orifice 79 is provided so as to allow greater flexibility between the upper and lower portions as the foot is being inserted into the protective device.

After the basic leg and foot protective device has been constructed by means such as molding and/or securing together the molded parts, it is preferred that the entire device be covered with a protective coating such as paint. In order to assure equal and complete coating, the device is preferably dipped into a vat containing the coating material.

As will now be evident, the present invention provides a leg and foot protective device which is of integral construction and which is relatively economically manufactured. Also, the device may be used with maximum convenience as to attachment and removal from the leg and foot. The means provided for securing the device to the leg and foot assures that it will remain in position during even the most rigorous use.

The above description and related drawings are illustrative only since variations in configuration of the device and location of the securing means may occur without departing from the invention, the scope of which is to be limited only by the following claims.

I claim:

1. An integral leg and foot protective device of soft energy absorbing material to be worn by a human comprising a lower portion having a concave configuration for covering the top and sides of the foot of the wearer;

a middle portion having a concave configuration for covering the front and sides of the ankle of the wearer;

an upper portion covering the shin of the wearer;

first strap means secured adjacent one end of said lower portion;

mating securing means attached to opposite ends of said first strap means, said first strap means being of a length so as to cross over the top of said lower portion, underneath said lower portion, and across the top of said lower portion including a section of said first strap means, with the free end of said first strap means being secured to said one end of said first strap means;

second strap means secured at one end to said upper portion;

mating securing means attached to opposite ends of said second strap means, said second strap means being of a length to pass about said upper portion with the free end of said second strap means being secured to said one end of said second strap means;

a plurality of perforations through said lower portion; and a lace of sufficient length to pass through said perforations and under said first portion with the ends of said lace being tied together below the inner surface of said lower portion.

2. The protective device of claim 1 wherein said strap means and said lace are elastic.

3. The protective device of claim 1 wherein two pairs of perforations extend through said lower portion and said lace has two parallel sections across the upper surface of said lower portion and crosses over itself below the inner surface of said lower portion.

4. The protective device of claim 1 further comprising a coating covering said protective device.

5. The protective device of claim 1 further comprising a unitary heel portion extending from the rear of said lower portion; and a unitary flap extending upwardly from said heel portion for a predetermined distance.

6. The protective device of claim 5 further comprising a third strap means secured at one end to said protective device between said first and second strap means;

mating securing means attached to opposite ends of said third strap means, said third strap means being of a length so as to pass about said protective device with the free end of said third strap means being secured to said one end of said third strap means.

7. The protective device of claim 1 further comprising a third strap means secured at one end to said protective device between said first and second strap means; and mating securing means attached to opposite ends of said third strap means, said third strap means being of a length so as to pass about said protective device with the free end of said third strap means being secured to one end of said third strap means.

8. A unitary leg and foot protective device of soft energy absorbing material comprising a lower portion having a concave configuration for covering the top and sides of the foot of the wearer;

a middle portion having a concave configuration for covering the front and sides of the ankle of the wearer;

an upper portion covering the shin of the wearer;

first strap means secured adjacent one end of said lower portion for securing said lower portion to the foot of the wearer;

second strap means secured to said upper portion for securing said upper portion to the leg of the wearer;

a plurality of perforations through said lower portion; and a lace having two parallel sections across the upper surface of said lower section and extending through said perforations, said lace crossing over itself below the inner surface of said lower portion with the free ends of said lace being tied together below the inner surface of said lower portion.

9. The protective device of claim 8 wherein said strap means and said lace are elastic.

10. The protective device of claim 8 further comprising a coating covering said protective device.

11. The protective device of claim 8 further comprising a unitary heel portion extending from the rear of said lower portion; and a unitary flap extending upwardly from said heel portion for a predetermined distance.

12. The protective device of claim 11 further comprising a third strap means secured at one end to said protective device between said first and second strap means for securing said middle portion to the leg of the wearer.

13. The protective device of claim 8 further comprising a third strap means secured at one end to said protective device between said first and second strap means for securing said middle portion to the leg of the wearer.

14. A unitary leg and foot protective device of soft energy absorbing material to be worn by a human comprising a lower portion having a concave configuration for covering the top and sides of the foot of the wearer;

a middle portion having a concave configuration for covering the front and sides of the ankle of the wearer;

an upper portion covering the shin of the wearer;

a first elastic strap secured adjacent to one end of said lower portion;

mating securing means attached to said one end and to the free end of said first elastic strap, said first elastic strap being of a length so as to cross over the top of said lower portion, underneath said lower portion, and across the top of said lower portion including a section of said first strap, with said free end of said first strap being secured to said one end of said first strap;

a second elastic strap attached at one end to said upper portion;

mating securing means attached to said one end of said second elastic strap and to the free end of said second elastic strap said second elastic strap being of a length to pass about said upper portion with said free end of said second strap being secured to said one end of said second strap;

a third elastic strap secured at one end to said protective device between said first and second elastic straps;

mating securing means attached to said one end of said third elastic strap and to the free end of said third elastic strap said third elastic strap being of a length to pass about said protective device with said free end of said third strap being secured to said one end of said third strap;

a plurality of perforations through said lower portion; and an elastic lace of sufficient length to pass through said perforations and under said first portion with the ends of said lace being tied together below the inner surface of said lower portion.

15. The protective device of claim 14 wherein two pairs of perforations extend through said lower portion and said lace crosses over itself beneath the foot of the wearer.

16. The protective device of claim 14 further comprising a coating covering said protective device.

17. The protective device of claim 14 further comprising a unitary heel portion extending from the rear of said lower portion; and a unitary flap extending upwardly from said heel portion for a predetermined distance.

18. The protective device of claim 17 further comprising a cut-out section between said lower portion and said middle portion for increasing the flexibility of said device between said lower portion and said middle portion.

19. The protective device of claim 14 further comprising an integral section of increased thickness extending along the interior length of said upper section; and an integral section of increased thickness in the interior of said lower portion.

* * * * *